United States Patent [19]

Bergman

[11] Patent Number: 4,474,003

[45] Date of Patent: Oct. 2, 1984

[54] GAS COMPRESSOR FOR A HOT GAS ENGINE

[75] Inventor: Ulf C. Bergman, Malmö, Sweden

[73] Assignee: United Stirling AB, Malmö, Sweden

[21] Appl. No.: 374,233

[22] Filed: May 3, 1982

[51] Int. Cl.[3] ..... F02G 1/06

[52] U.S. Cl. ..... 60/521; 60/525

[58] Field of Search ..... 60/517, 521, 525

[56] References Cited

U.S. PATENT DOCUMENTS

| | | | |
|---|---|---|---|
| 3,827,240 | 8/1974 | Lundquist | 60/521 |
| 3,914,940 | 10/1975 | Bergman | 60/521 |
| 3,999,388 | 12/1976 | Nystrom | 60/521 |
| 4,179,891 | 12/1979 | Gronvall | 60/521 |

*Primary Examiner*—Allen M. Ostrager
*Assistant Examiner*—Stephen F. Husar
*Attorney, Agent, or Firm*—Finnegan, Henderson, Farabow, Garrett & Dunner

[57] ABSTRACT

A gas compressor for compressing working gas of a hot gas engine is using the oscillating pressure of a working gas charge for acting upon the large diameter piston of a differential piston the small diameter part of which is used as compressor piston. One side of the large diameter piston is directly connected to a variable volume chamber of the hot gas engine while the other side of the same piston is alternatively connectable either to a minimum or a maximum gas pressure source.

6 Claims, 2 Drawing Figures

GAS COMPRESSOR FOR A HOT GAS ENGINE

This invention relates to a gas compressor for a hot gas engine.

More specifically the invention relates to a compressor of the type which is driven by differential gas pressure variations across a free piston (also called a "differential piston") in which a small diameter piston part is working in a compressor cylinder.

A known design of such compressor has been shown e.g. in the U.S. Pat. No. 3,827,240. This known design is based upon the principle that a maximum differential cycle pressure is continuously applied in one direction across the large diameter part of the differential piston during the piston movement and is caused to shift direction at the travel end positions of the piston resulting in a reciprocation of the piston. Microswitches actuated by the piston movements are used to govern valves for the gas flows. The compressor must therefore have rather a large displacement capacity in order to avoid the necessity of a high compressor movement frequency which would wear out the switches.

The object of the present invention is to design a compressor which is simpler and more reliable than conventional compressors for hot gas engines.

According to the present invention this object is obtained by structure wherein the large diameter piston part of the differential piston divides a cylinder into first and second variable volume chambers the first being directly connected to a part of the hot gas engine containing a working gas charge, whereas the second variable volume chamber, through which the small diameter piston part is passed, is selectively connected either to a gas source of minimum working gas pressure or a gas source of maximum working gas pressure, depending upon the power requirement of the hot gas engine.

Figure 1:
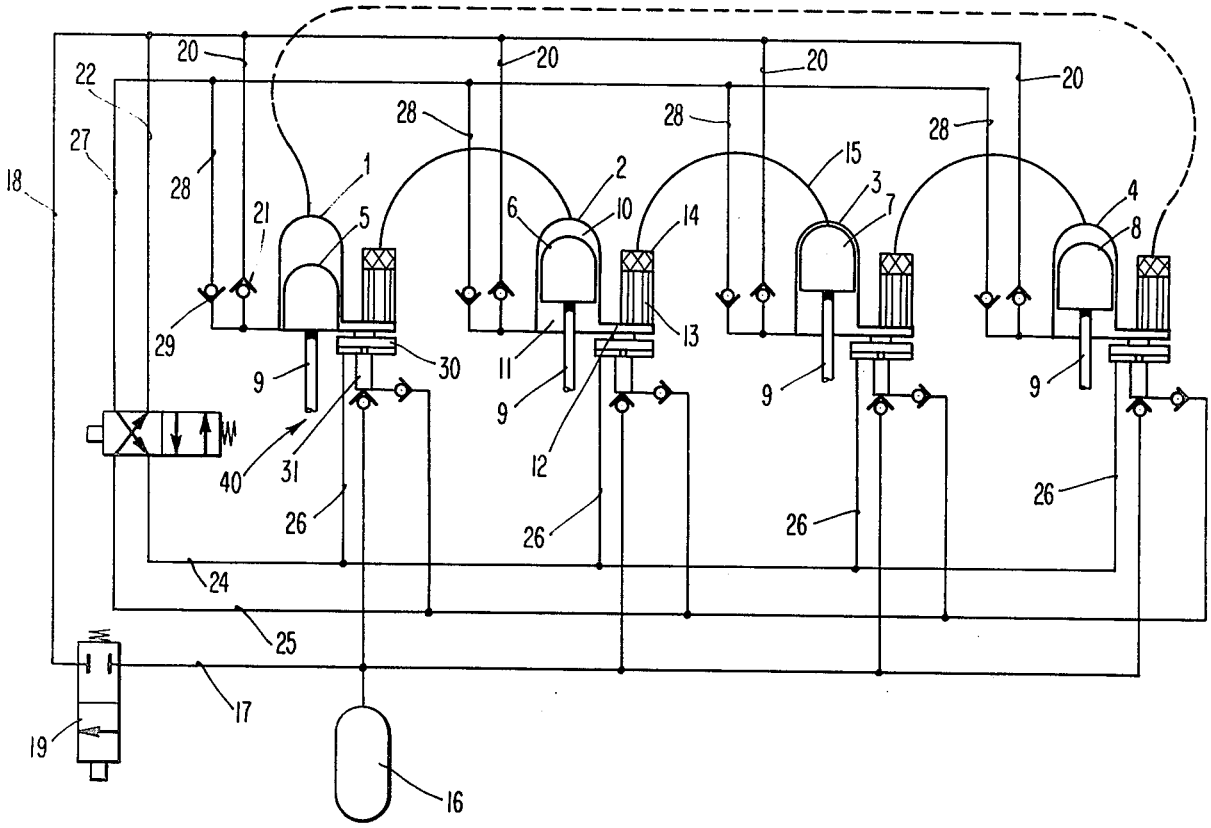
Figure 2:
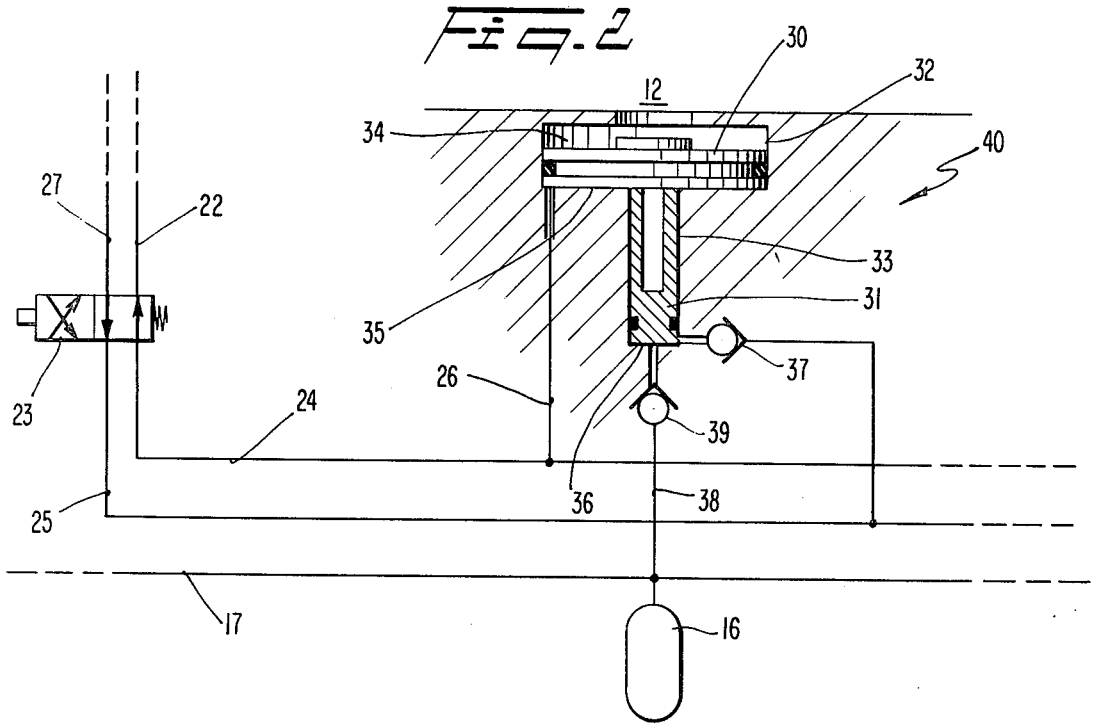

The invention will be described in more detail reference being made to the drawing in which FIG. 1 schematically shows the gas connections of a four-cylinder hot gas engine provided with four gas compressors according to the invention; and FIG. 2 shows a vertical section of a gas compressor according to the invention at a larger scale.

The hot gas engine to which the system of FIG. 1 is applied has four cylinders 1–4 each having a piston 5–8 slidably arranged therein.

Each piston 5–8 carries a piston rod 9 connected to a drive mechanism (not shown). Each piston divides the cylinder in which it is mounted into an upper variable volume chamber and a lower variable volume chamber. The upper chamber of the cylinder 2 has been designated by 10 and the lower chamber of the cylinder 2 has been designated by 11 whereas none of the remaining chambers have reference numerals for the sake of clarity.

During running of the engine the pistons 5–8 are cyclically oscillating in the cylinders 1–4 at 90 degrees relative displacement. Thus in the positions shown the piston 5 is in its lowermost position, the piston 6 on its way down, the piston 7 in its uppermost position, and the piston 8 on its way up.

The lower variable volume chamber 11 of the cylinder 2 is connected to the upper variable volume chamber of the cylinder 3 via a cold gas connecting duct 12, a gas cooler 13, a regenerator 14 and a heater head 15. The gas cooler serves to cool the working gas by passing it through a number of tubes surrounded by cooling water. The regenerator consists of a container partly filled with wire filaments and serves to absorb heat from, and give off heat to, an oscillating flow of working gas. The heater head consists of a plurality of tubes of which only one—15—is shown. The heater head is heated by any source of heat—e.g. a burner or a solar radiation concentrating mirror.

The engine described thus far is known per se and has four working gas charges each of which being cyclically cooled, compressed, heated and expanded and thereby undergoing a cyclical change in pressure. Each working gas charge is constrained in part by the lower side of one piston (e.g. the piston 6 in cylinder 2) and the upper side of another piston (e.g. the piston 7 in a neighboring cylinder 3).

Provided that the coolers 13 and the heater heads 15 are kept at constant temperature levels, and provided that the engine is run at a constant speed, the torque (and thus the power) of the engine may be adjusted by varying the means pressure of the working gas charges. This is a known power control system for hot gas engines.

With continued reference to FIG. 1, a gas tank 16 is connected to a tube 17 which is connected to another tube 18 via a valve 19. The tube 18 is connected to the lower variable volume chambers 11 of the engine via four branched off tubes 20 each containing a check valve 21 (only one of the four valves is numbered, for clarity) allowing only gas flow in the direction from the tank 16 into the engine.

A further branched off tube 22 is connected to a valve 23 connecting it alternatively to a tube 24 or a tube 25.

The tube 24 is directly connected to a differential piston compressor 40 (only one of four compressors being numbered) at each cold gas connecting duct 12 via branched off tubes 26.

The valve 23 is also connected to a tube 27 which may be alternatively connected to one of the tubes 24 and 25. Said tube 27 is connected to the lower volume chambers 11 of each cylinder via branched off tubes 28, containing check valves 29 allowing flow only in the direction from the chambers 11.

In FIG. 2 a differential piston 30, 31 is composed of a large diameter piston 30 having a piston rod acting as a small diameter piston 31. The large diameter piston 30 is slidably mounted in a cylinder 32, whereas the piston 31 slides in a cylinder 33. The piston 30 divides the cylinder 32 into upper and lower variable volume chambers 34 and 35 respectively. The chamber 35 is not visible in the drawing as the piston 30, 31 is in its lowermost position. The piston 31 limits a variable volume chamber 36 in the cylinder 33. Also the chamber 36 is not visible due to the position of the piston 30, 31.

The device described and shown will operate as follows:

If the power is to be increased the valve 19 is switched from the position shown in FIG. 1 to a position in which the tubes 17 and 18 are interconnected. Gas may now pass from the tank 16 via the tubes 17, 18 and 20 into the four lower variable volume chambers of the engine. As soon as sufficient gas has been supplied the valve 19 is again switched into the position shown in FIG. 1.

It will be understood that due to the tubes 20, 28 connecting the variable volume chambers 11 (containing working gas at cyclically varying pressure) and having check valves 21, 29 aligned as discussed above, the tube 27 will always contain gas at maximum cycle pressure and the tube 18 will always contain gas at minimum cycle pressure.

In the position shown in FIG. 1 the valve 23 will connect the tube 24 to the tube 27 and thus contain gas at maximum cycle pressure. Thus the differential pistons of the four compressors will be moved towards their upper end positions and remain there without moving due to maximum gas pressure in the variable volume chamber 35. The gas pressure in the variable volume chamber 34 is always the cyclically varying pressure of the working gas charge in the neighboring gas connecting duct 12 with which it is directly connected.

If the valve 23 is shifted into the position shown in FIG. 2 the tube 24 will obtain minimum cycle gas pressure and the tube 25 maximum cycle gas pressure. The tube 25 is connected to the variable volume chamber 36 via a check valve (designated by 37 in FIG. 2). The variable volume chamber 36 is also directly connected to the tank 16 via a tube 38 (containing a check valve 39) which is connected to tube 18. The valve 37 allows only gas flow in the direction into the chamber 36 and the valve 39 allows only gas flow in the direction from the chamber 36.

It will be understood that the constant minimum gas pressure in the chamber 35, the constant (or somewhat higher) maximum gas pressure in the chamber 36 and the variable pressure in the chamber 34 will cause an reciprocating movement of the differential piston 30, 31. When pressure in chamber 34 is high, corresponding to the maximum cycle pressure, differential piston 30, 31 is forced downward. When pressure in chamber 34 is low, corresponding to the minimum cycle pressure (which is also the pressure in chamber 35), the high pressure in chamber 36 of the small piston provides a net upward force causing differential piston 30, 31 to return to the original upper position to begin another reciprocation cycle. Thus a pumping of gas from the tube 25 into the tank 16 will occur due to the concurrent reciprocation of small piston part 31 in cylinder 33. This will cause a decreasing maximum working gas pressure and thus also a decreasing mean pressure of the working gas. The valve 23 will be kept in its position shown in FIG. 2 until the desired decrease in power output has been obtained.

It will be understood that the reciprocation frequency of the pump will correspond to the frequency of the working gas pressure oscillations. Therefore, the dimensions of the cylinder 33 may be very small and it will be easy to fit the pump into the engine block.

I claim:

1. In a gas compressor for a hot gas engine having an engine part containing a working gas charge of cyclically varying pressure, a working gas reservoir, and a source of working gas maintained at a pressure corresponding to the minimum cycle pressure, and a source of working gas maintained at a pressure corresponding to the maximum cycle pressure, the gas compressor being of the type having a free piston reciprocably driven by differential gas pressure and including a large diameter portion and a small diameter portion, the small diameter portion being slidably disposed in, and cooperating with, a small diameter cylinder for pumping working gas back to the reservior from the engine part during reciprocation of the piston, the small diameter cylinder having an inlet for admitting the working gas to be pumped, the large diameter portion being slidably disposed in a large diameter cylinder and dividing that cylinder into first and second variable volume chambers, the improvement comprising:

means for flow-connecting the first variable volume chamber to the engine part containing the working gas charge, said flow-connecting means providing essentially unrestricted flow both to and from the engine part; and means for selectively flow-connecting the second variable volume chamber to the minimum working gas pressure source and selectively flow-connecting the inlet to the small cylinder to the maximum pressure source, said flow connections to be made whenever the working gas is to be pumped back to the reservoir, the respective flow connections to the minimum and maximum working gas pressure sources being maintained during movement of the pistons.

2. The improved gas compressor as in claim 1 wherein the small diameter piston portion extends through the second variable volume chamber.

3. The improved gas compressor as in claim 1 wherein the hot gas engine part containing the working gas charge includes a gas cooler and a variable volume region, and a cold gas duct interconnecting the variable volume region and the gas cooler, and wherein said flow-connecting means connects the first variable volume chamber and the cold gas duct.

4. In a gas compressor for a hot gas engine having an engine part which contains a working gas charge of cyclically varying pressure, a working gas reservoir, and a source of working gas maintained at a pressure corresponding to the minimum cycle pressure, and a source of working gas maintained at a pressure corresponding to the maximum cycle pressure, the gas compressor being of the type having a free piston reciprocably driven by differential gas pressure and including a large diameter portion and a small diameter portion, the small diameter portion being slidably disposed in and cooperating with, a small diameter cylinder for pumping working gas back to the reservior from the engine part during reciprocation of the piston, the small diameter cylinder having an inlet for admitting the working gas to be pumped, the large diameter portion being slidably disposed in a large diameter cylinder and dividing that cylinder into first and second variable volume chambers, the improvement comprising:

means for flow-connecting the first variable volume chamber to the engine part containing the working gas charge, said flow connecting means providing essentially unrestricted flow both to and from the engine part;

means for selectively flow-connecting the second variable volume chamber to the minimum working gas pressure source and for selectively flow-connecting the inlet to the small cylinder to the maximum pressure source, said flow-connections to be made whenever the working gas is to be pumped back to the reservoir, the respective flow connections to the minimum and maximum working gas pressure sources being maintained during movement of the piston;

biasing means for preventing reciprocation of the piston whenever no working gas is to be pumped back to the reservoir.

5. The improved gas compressor as in claim 4 wherein said biasing means includes valve means for flow-connecting the second variable volume chamber to the maximum working gas pressure source whenever no working gas is to be pumped back to the reservoir, whereby the free piston is prevented from reciprocating.

6. The improved gas compressor as in claim 5 wherein said valve means also is part of said selective flow-connection means, said valve means connecting the second variable volume chamber to the minimum working gas pressure source whenever working gas is to be pumped to the reservoir, and connecting the second variable volume chamber to the maximum working gas pressure source whenever no working gas is to be pumped to the reservoir.

* * * * *